US006283665B1

(12) United States Patent
Onischuk

(10) Patent No.: US 6,283,665 B1
(45) Date of Patent: Sep. 4, 2001

(54) GLUE GUN NOZZLE AND METHOD OF INSTALLING CARPETING

(76) Inventor: Christopher M. Onischuk, 8712 W. 26th, North Riverside, IL (US) 60546

( * ) Notice: Subject to any disclaimer, the term of this patent is extended or adjusted under 35 U.S.C. 154(b) by 0 days.

(21) Appl. No.: 09/697,584

(22) Filed: Oct. 26, 2000

Related U.S. Application Data

(62) Division of application No. 09/325,058, filed on Jun. 3, 1999, now Pat. No. 6,196,746.
(60) Provisional application No. 60/088,293, filed on Jun. 5, 1998.

(51) Int. Cl.[7] ..... A47L 13/30
(52) U.S. Cl. ..... 401/266; 401/261; 401/265; 156/304.4; 156/304.7
(58) Field of Search ..... 156/304.7, 304.4; 401/261, 265, 266, 267

(56) References Cited

U.S. PATENT DOCUMENTS 4,536,244 * 8/1985 Greci et al. ..... 156/304.4
5,250,145 * 10/1993 Despins et al. ..... 156/304.7
5,384,001 * 1/1995 Hoopengardner ..... 156/304.4
5,824,175 * 10/1998 Hoopengardner ..... 156/304.7

* cited by examiner

*Primary Examiner*—David J. Walczak
(74) *Attorney, Agent, or Firm*—Niro, Scavone, Haller & Niro

(57) ABSTRACT

A method and apparatus for forming a carpet seam using a nozzle adapted to apply hot melted adhesive received from a hot glue gun to a carpet edge having vertical and horizontal edges. The nozzle has a body having a base adapted to be received by a hot glue gun and to receive adhesive from the glue gun. The body also includes a bore which terminates in an opening located on a first surface of the body. A second surface adjacent to the first surface is provided which is adapted to co-extensively engage the vertical and horizontal carpet edges and to apply adhesive to the vertical carpet edge of the carpet.

1 Claim, 2 Drawing Sheets

FIG. 2
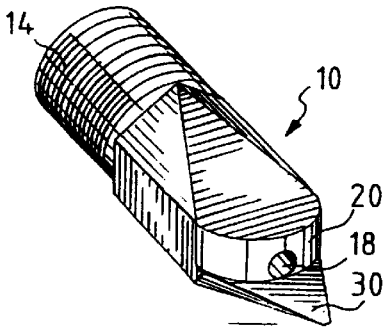
FIG. 3
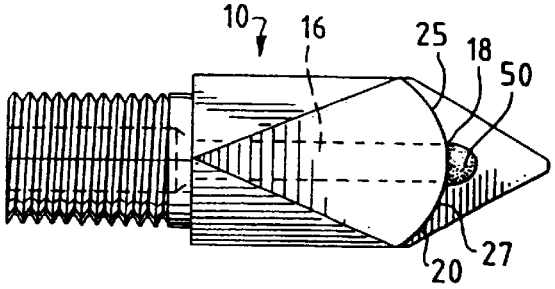
FIG. 5
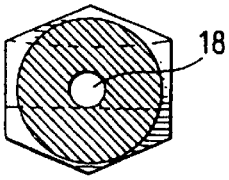
FIG. 4
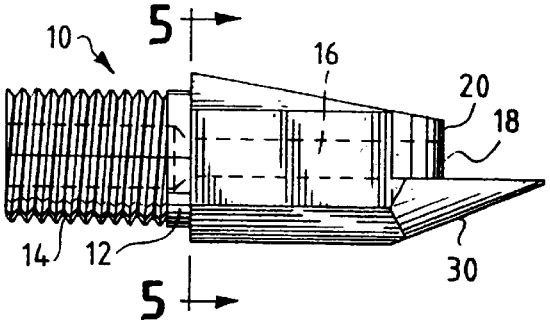
FIG. 7
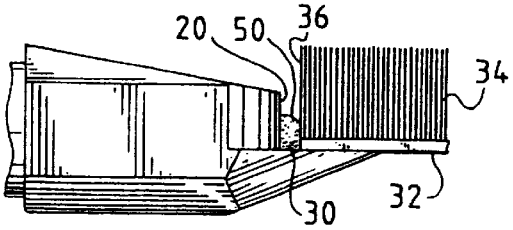
FIG. 6
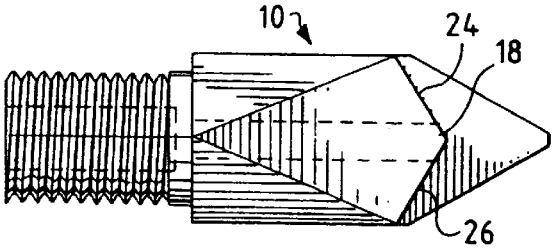
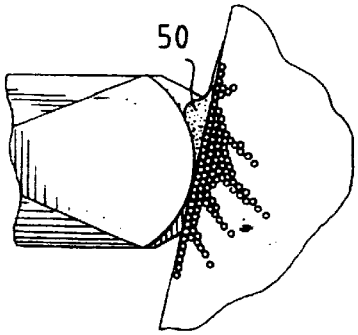
FIG. 8

GLUE GUN NOZZLE AND METHOD OF INSTALLING CARPETING

This application is a Divisional Application of Applicant's earlier filed application Ser. No. 09/325,058, filed Jun. 3, 1999, now U.S. Pat. No. 6,196,746.

FIELD OF THE INVENTION

This application claims priority to pending U.S. Provisional Patent Application Ser. No. 60/088,293, filed Jun. 5, 1998.

The invention relates to a novel apparatus and method for applying carpeting to a surface. More specifically, the invention relates to a unique nozzle that may be used in combination with a hot glue gun to improve the quality of the seams created in a carpet installation.

BACKGROUND OF THE INVENTION

In the carpet installation profession, the juncture at which two edges of a carpet roll meet is commonly referred to as a seam. Because a seam receives the tension created in a carpet, the seam is susceptible to unraveling, peaking, and delamination. Thus, in the carpet installation profession, there always is a need to create a seam with improved adhesion strength.

SUMMARY OF THE INVENTION

Accordingly, an object of the present invention is to provide a device which improves seam strength over those currently in use, as well as a novel method by which carpet seams may be created.

In accordance with one aspect of the invention, a hot glue gun having a uniquely configured nozzle is provided. The nozzle is adapted to provide hot glue to the vertical edge of the carpet. To do this efficiently and accurately, the base of the nozzle includes an L-shaped cut-out portion or guide walls which engage the carpet edge. On the vertical leg of the L-shaped or vertical guide wall, an aperture is located through which hot adhesive flows. This allows the adhesive to be applied directly to the vertical edge of the carpet.

Once adhesive is applied to the vertical edge, the ends of the carpet are abutted together. A hot iron and hot melt seaming tape are then used to complete the seam formation process. The application of heat from the hot iron reactivates the previously applied adhesive, thus allowing the adhesive to bond the two edges of carpet. This further strengthens the seam.

Additional objects and advantages of the invention will be apparent from the detailed description of the preferred embodiment, the appended claims and the accompanying drawing may be learned by practice of the invention.

BRIEF DESCRIPTION OF THE DRAWINGS

The accompanying drawings, which are incorporated in and constitute a part of this specification illustrates a preferred embodiment of the preferred invention and together with the description serve to explain the principles of the invention. In the drawings, the same reference numerals indicate the same parts.

FIG. 2 is a perspective view of the nozzle of the present invention;

FIG. 3 is a top plan view of the embodiment of the invention shown in FIG. 2;

FIG. 4 is a side view of the embodiment of the invention shown in FIG. 2;

FIG. 5 is a cross sectional view of the embodiment of the invention shown in FIG. 4 taken along line 4—4;

FIG. 6 shows an alternate embodiment of the present invention showing angled guide walls; and FIGS. 7 and 8 show how hot melt adhesive is applied by the present invention to a carpet edge.

DESCRIPTION OF THE PREFERRED EMBODIMENT

Figure 1:
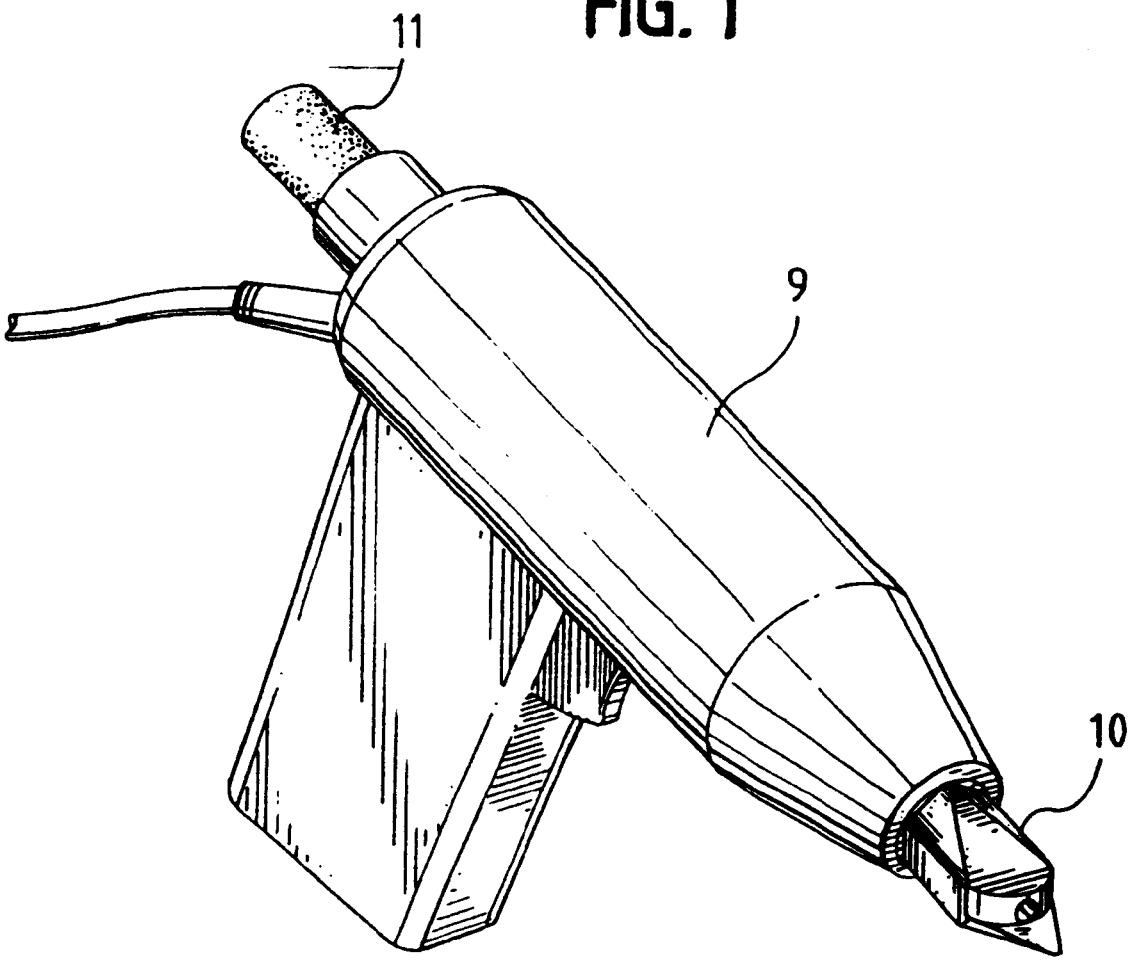
FIG. 1 is a perspective view of a hot glue gun employing the nozzle of the present invention.

FIG. 1 shows a hot glue gun 9 employing nozzle 10 of the present invention. Gun 9 may be of the design currently available on the market and sold by BLACK & DECKER®, CRAFTSMAN®, ARROW®, and others.

As shown in FIGS. 2–4, nozzle 10 includes a threaded barrel 14 which is adapted to be received by a coacting threaded portion on gun 9. Running through the body 12 of nozzle 10 is a bore 16 which is positioned to receive melted glue 11 from gun 9. Bore 16 terminates in opening 18 located on first tip surface 20 which may be curved in configuration as shown in FIG. 3. Alternatively, as shown in FIG. 6, surface 20 may also be angular in shape with opening 18 being positioned at a point formed by walls 24 and 26.

As shown in FIG. 4, second tip surface 30 which is perpendicularly located adjacent to surface 20, and below opening 18, is also provided. As further shown in FIG. 7, surfaces 20 and 30 are configured to form surfaces or guide walls that are L-shaped in configuration in order to form guides which co-extensively engage a bottom portion 32 of a piece of carpet 34 and the vertical edge portion 36 of carpet 34.

In use, nozzle 10 is affixed to a standard hot glue gun and, as shown in FIG. 7, surface of guide 30 is slid under the bottom edge 32 of carpet 34. Nozzle 10 is made of brass and is chrome plated, but other materials may be used as well. As a result of the generally perpendicular angle formed by surfaces 20 and 30, when surface 30 is in position, surface 20 may also be positioned proximate to the vertical edge 36 of carpet 34. This also allows opening 18 to be positioned directly against the lower most point of vertical edge 36 as a result of opening 18 being located just above surface 30. The two surfaces then act as guides that allow a user to quickly and efficiently apply adhesive to vertical edge 36 as shown in FIG. 7.

Angling or curving walls 24–27 rearwardly serves several purposes. First, it provides a clear view of the bead of glue 50 that is being applied to edge 36 which enhances ease of use. Second, it allows for right or left-handed operation. Lastly, it allows a user to form a bead of glue 50 on surfaces 20 and 30 which may then be applied along vertical edge 36 of the carpet without the repeated triggering of glue gun 9.

Once adhesive 50 is applied, the edges of the carpet are attached and hot melt seaming tape or some other type of seam tape is applied. Heat and pressure are then applied by an iron. To melt the seaming tape, the application of heat from the iron re-melts and/or reactivates the previously applied adhesive from the nozzle allowing it to further bond, not only from the bottom where the hot melt tape is, but also from the sides where extra strength is needed. It has been found that reactivating the previously applied adhesive creates a stronger and longer lasting bond at the seam than the method currently used in the trade.

Using a hot adhesive application not only provides a superior seam over current methods, it also provides for a quicker installation. In current applications, contact cement or latex adhesive may be applied to edge 32. Once applied, it takes the latex or contact cement approximately 5–20 minutes to dry. The method of the present invention, on the other hand, takes approximately one minute for the adhesive to dry. In addition, the latex and contact cement adhesives are not reactivated by an application of heat. Thus, no improvement in seam strength is achieved by allowing the adhesive to reset in the seam.

It should be understood that various changes and modifications to the preferred embodiments described would be apparent to those skilled in the art. For example, changes and modifications can be made without departing from the spirit and scope of the present invention and without diminishing its intended advantages. It is, therefore, intended that such changes and modifications be covered by the following claims.

What is claimed is:

1. A method for creating a seam from two carpet pieces having vertical edges comprising:

applying hot melted adhesive to at least one vertical edge of said carpet;

attaching said vertical edges together after said application of said adhesive to form a carpet seam;

applying seam tape to said carpet seam; and applying heat and pressure to said seam to reactivate said adhesive to form a carpet seam.

* * * * *